US008790036B2

(12) United States Patent
Halahmi et al.

(10) Patent No.: US 8,790,036 B2
(45) Date of Patent: Jul. 29, 2014

(54) GEOTECHNICAL STRUCTURES AND PROCESSES FOR FORMING THE SAME

(75) Inventors: Izhar Halahmi, Hod Hasharon (IL); Oded Erez, Tel Aviv (IL); Adi Erez, Tel Aviv (IL)

(73) Assignee: PRS Mediterranean Ltd., Tel Aviv (IL)

( * ) Notice: Subject to any disclaimer, the term of this patent is extended or adjusted under 35 U.S.C. 154(b) by 47 days.

(21) Appl. No.: 12/825,594

(22) Filed: Jun. 29, 2010

(65) Prior Publication Data

US 2011/0217117 A1 Sep. 8, 2011

Related U.S. Application Data

(60) Provisional application No. 61/311,006, filed on Mar. 5, 2010.

(51) Int. Cl.
*C09K 17/00* (2006.01)
*E01C 3/04* (2006.01)

(52) U.S. Cl.
USPC ..... 404/28; 404/70; 405/302.4

(58) Field of Classification Search
USPC ..... 405/302.4, 302.6; 404/28, 70, 71
See application file for complete search history.

(56) References Cited

U.S. PATENT DOCUMENTS 3,990,247 A * 11/1976 Palmer ..... 405/16
4,428,698 A 1/1984 Murphy et al.
4,792,133 A 12/1988 Hawkins et al.
4,797,026 A * 1/1989 Webster ..... 404/28
4,965,097 A * 10/1990 Bach ..... 428/194
5,449,543 A 9/1995 Bach et al.
5,927,906 A * 7/1999 Bach et al. ..... 405/302.6
6,296,924 B1 * 10/2001 Bach ..... 428/137
6,395,372 B1 * 5/2002 Bach ..... 428/137
7,470,092 B2 * 12/2008 Bonasso ..... 405/284
7,993,080 B2 * 8/2011 Erez et al. ..... 405/284
8,025,457 B2 * 9/2011 Halahmi et al. ..... 404/70
8,157,472 B2 * 4/2012 Halahmi et al. ..... 404/70
8,173,241 B2 * 5/2012 Halahmi et al. ..... 428/119
2004/0062615 A1 4/2004 Walsh
2010/0254795 A1 * 10/2010 Halahmi et al. ..... 414/800
2011/0243670 A1 * 10/2011 Erez et al. ..... 405/284

OTHER PUBLICATIONS

International Search Report and Written Opinion, Date of mailing Sep. 1, 2010.

* cited by examiner

*Primary Examiner* — Gary Hartmann

(74) *Attorney, Agent, or Firm* — Richard M. Klein; Fay Sharpe LLP

(57) ABSTRACT

Disclosed are geotechnical structures formed from a geosynthetic article and an encapsulated granular material dispersed within or upon the geosynthetic article. In particular embodiments, a geocell is used as the geosynthetic article. Among other things, the geotechnical structures can be used for forming roads, parking lots, paved surfaces, as well as road beds and foundations for highways or railroads.

17 Claims, 4 Drawing Sheets

GEOTECHNICAL STRUCTURES AND PROCESSES FOR FORMING THE SAME

This application claims priority to U.S. Provisional Patent Application Ser. No. 61/311,006, filed Mar. 5, 2010. The disclosure of that application is hereby fully incorporated by reference herein.

BACKGROUND

The present disclosure relates to geotechnical structures and processes for forming the same. Among other advantages, the geotechnical structures are cost-effective and improve on deficiencies associated with the materials normally used in prior art structures.

A cellular confinement system (CCS) is an array of containment cells resembling a "honeycomb" structure that is filled with granular infill, which can be cohesionless soil, sand, gravel, ballast, crushed stone, or any other type of granular aggregate. Also known as geocells, CCSs are mainly used in civil engineering applications that require moderate mechanical strength and stiffness, such as slope protection (to prevent erosion) or providing lateral support for slopes, as well as for providing limited vertical load support, usually for temporary unpaved roads.

CCSs differ from other geosynthetics such as geogrids or geofabrics in that geogrids/geofabrics are flat (i.e., two-dimensional, with very small height in relation to length and width) and used as planar reinforcement. Geogrids/geofabrics provide confinement only for very limited vertical distances (usually 1-2 times the average size of the granular material) and are limited to granular materials having an average size of greater than about 20 mm. This limits the use of such two-dimensional geosynthetics to relatively expensive granular materials (ballast, crushed stone and gravel) because two-dimensional geosynthetics provide little confinement or reinforcement to finely-sized granular materials, such as sand, crushed concrete and quarry screenings.

In contrast to the above, CCSs are three-dimensional structures that provide confinement in all directions (i.e. along the entire cross-section of each cell). Moreover, the multi-cell geometry provides passive resistance that increases the bearing capacity. Unlike two-dimensional geosynthetics, a geocell provides confinement and reinforcement to granular materials having an average particle size less than about 20 mm, and in some cases materials having an average particle size of about 10 mm or less. However, current geocells are made of polyethylene (usually medium or high density polyethylene, referred as MDPE and HDPE).

As used herein, the term "geotechnical structure" refers to the combination of (1) a geosynthetic article, such as geogrids, geofabrics, and geocells, including combinations thereof; with (2) an infill granular material such as soil, crushed rock, sand, crushed stone, crushed concrete, and earth materials. Geotechnical structures generally have increased load bearing capacity, stability, and erosion resistance compared to the infill material itself.

In particular, geocells contribute to the strength of the surrounding materials and materials contained within the cells in several ways. First, the lateral stress exerted by the cell walls on the infill contained therein increases when a compressive stress is applied to the surface of the geocell. The increase in the lateral, confining stress can be as large as the increase in the applied compressive stress. Because the strength of the infill material depends on the lateral stress, an increase in the lateral stress increases the strength of the infill material. In fact, using a stiff wall to confine the infill would create a situation where any increase in compressive stress will resemble a state of hydrostatic stress increase (i.e., the stress increases equally in all directions). This results in only a small shear stress in the confined infill. As a result, the confined infill exhibits a greater lateral strength for a given depth, compared to unconfined fill.

This principle can be illustrated by reviewing the characteristics of soil at various depths. Heaped as a pile on a surface, soil has zero confinement and thus zero strength when a compressive stress is applied (i.e., a mound of soil flattens when pressed down upon). However, when confined, such as when the soil is in the ground, trying to drive a stake into the ground gets more difficult the deeper one tries to drive it, i.e. the strength of the soil increases. This is because the deeper soil is confined, and thus cannot move laterally to relieve the stress placed upon it.

Typical infill materials for geotechnical structures are naturally available materials or low cost materials. Such infill materials include recycled asphalt concrete (RAP), naturally abundant sand (such as river sand), crushed concrete, crushed bricks, or recycled plastics or rubber. Some problems that result from using these materials include the high tendency of crushed concrete and bricks to absorb water through capillary mechanisms; the tendency of RAP to creep under heavy loads, a tendency that become worse as temperature increases; poor resistance of sand to water and wind erosion; and the lack of a granular skeleton or cohesion for organic aggregates like recycled plastics. Because of the relatively high content of fines and the lack of cohesion, these materials are not generally used in structural applications intended for long periods of time.

It would be desirable to develop a geotechnical structure that utilizes low-cost granular materials for structural applications such as roads, parking lots, or railways, and improves the drawbacks associated with the materials normally used in prior art structures.

BRIEF DESCRIPTION

The present application discloses, in various embodiments, geotechnical structures comprising a geosynthetic article and an encapsulated granular material. These geotechnical structures can be used to form reinforced slopes and walls; roads, parking lots, pavements, road beds, foundations of roads, parking lots, railroads, and other open ways for travel and transportation. Also disclosed are processes for forming the geotechnical structures.

Disclosed in embodiments is a geotechnical structure comprising a geosynthetic article; and an encapsulated granular material dispersed within or upon the geosynthetic article, the encapsulated granular material comprising a granular material and an organic cohesive material encapsulating the granular material.

The geosynthetic article is a geogrid, geotextile, or geocell. The granular material is particles with a diameter of from 0.01 mm to 50 mm that are useful for civil engineering.

In one preferred embodiment, the granular material is selected from crushed stone, dune sand, crushed concrete, or river sand. In other embodiments, the encapsulated granular material is recycled asphalt concrete.

Because the interaction between the particles of the granular material is insufficient for most load-bearing applications, even when reinforced by geosynthetics, additional factors are required. It is thus another aspect of the present disclosure to provide a novel combination of granular material, geosynthetic, and organic cohesive material.

The organic cohesive material may comprise bitumen, a bituminous emulsion, a bitumen derivative, a polymer emulsion, a polymer dispersion, a polymer solution, an oil derivative, vegetable oil and derivatives thereof, a carbohydrate and derivatives thereof, a protein, and mixtures thereof.

In particular embodiments, the geosynthetic article is a geocell or a geogrid; the organic cohesive material is a bitumen derivative, a polymer emulsion, vegetable oil, or an oil derivative; and the granular material is asphalt concrete, sand, or crushed concrete.

Also disclosed is a geotechnical structure comprising a geocell or geogrid, and a reinforcing granular material that is encapsulated by bituminous cohesive material and dispersed/interacting with the geocell or geogrid.

In some embodiments, the encapsulated granular material is recycled asphalt concrete (RAP). The RAP is generated during rehabilitation of old asphaltic roads, and comprises crushed stone and asphalt. However, when compacted and re-used for pavements or railways bases, RAP is subject to severe creep, especially at temperature greater than 30 degrees Celsius. Surprisingly, when RAP is compacted within a geocell or onto a geogrid, its creep tendency is significantly suppressed. The geocell is more efficient than a geogrid, but a geogrid still provides a useful effect. It should be noted that asphalt concrete can also be considered the granular material, which is then encapsulated by the addition of more organic cohesive material.

In another aspect of the present disclosure, a layer of a pavement or railway base is provided that comprises a geosynthetic article and compacted RAP, characterized by a resistance to penetration greater than the compacted RAP alone without the geosynthetic article.

The resistance to penetration (RTP) is measured by applying a pressure of 500 Kilopascals (kPa) on a 300 mm thick compacted granular material, for a period of 7 days at 30 degrees Celsius. The pressure is applied by a plate of 150 mm diameter. The depth of penetration (DOP) of the plate into the compacted granular material is measured.

In one embodiment, the ratio of the DOP of unreinforced compacted RAP to the DOP of reinforced RAP is greater than 1.2.

In another embodiment, the ratio of the DOP of unreinforced compacted RAP to the DOP of reinforced RAP is greater than 1.5.

In another embodiment, the ratio of the DOP of unreinforced compacted RAP to the DOP of reinforced RAP is greater than 2.

Also disclosed is a reinforced slope, embankment, or wall comprising a geotechnical structure; wherein the geotechnical structure comprises a geocell; and an encapsulated granular material dispersed within or upon the geocell, the encapsulated granular material comprising a granular material and an organic cohesive material encapsulating the granular material.

In some embodiments, the granular material is sand, crushed stone, crushed concrete, or crushed brick; and the organic cohesive material is a polymer emulsion, a polymer dispersion, a polymer solution, a bitumen derivative, or an oil derivative.

The polymer in the polymer emulsion, polymer dispersion, or polymer solution may be a styrene-acrylate copolymer, a vinyl acetate, or an acrylate.

Described in other embodiments is a paved road, comprising a top layer and at least one lower layer. The top layer is selected from asphalt concrete, concrete, hot mix aggregate, and cold mixed aggregate. The lower layer comprises a granular material, an organic cohesive material encapsulating the granular material, and a geosynthetic article reinforcing the encapsulated granular material. The lower layer serves as a road bed or foundation.

Also disclosed are processes for constructing a geotechnical structure, the process comprising: mixing the granular material with an organic cohesive material to form an encapsulated granular material; filling the geocell or covering a geogrid or geotextile with said encapsulated granular material; and optionally compacting the encapsulated granular material.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
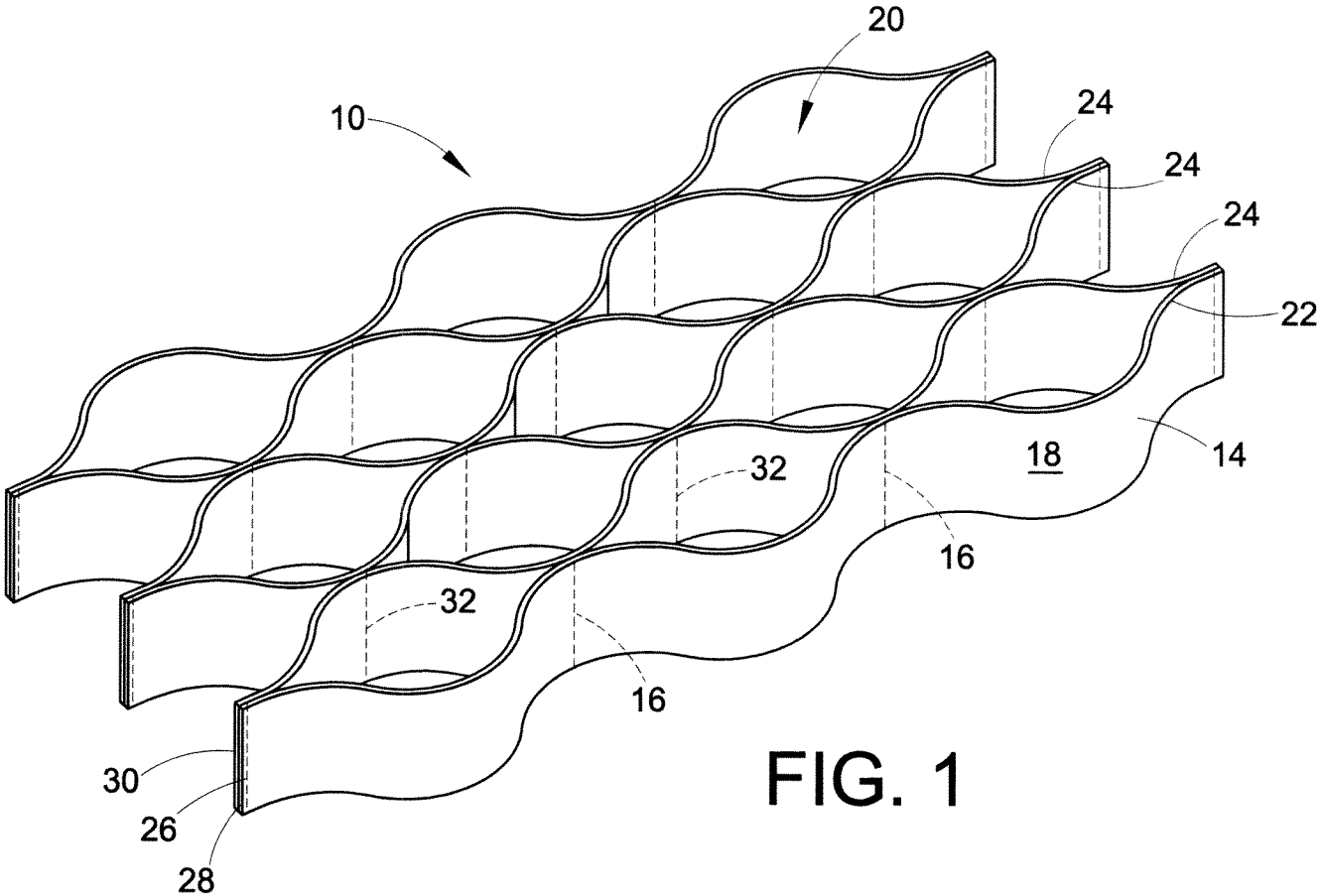
FIG. 1 is a perspective view of a geocell.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

As used in the specification and in the claims, the term "comprising" includes the embodiments "consisting of" and "consisting essentially of."

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10."

The present disclosure relates to geotechnical structures that are useful in improving the load-bearing capacity, stability, and erosion resistance of land and structures contained thereon. The geotechnical structures comprise a geosynthetic article and an encapsulated granular material dispersed within or upon the geosynthetic article. The encapsulated granular material comprises a granular material and an organic cohesive material encapsulating the granular material.

The present disclosure also relates to reinforced slopes, reinforced walls, roads, parking lots, pavements, foundations, and road beds or railway beds comprising the geotechnical structure. The roads may be paved or unpaved. Also disclosed are processes for constructing the geotechnical structure.

FIG. 1 is a perspective view of a single layer geocell. The geocell 10 comprises a plurality of polymeric strips 14. Adjacent strips are bonded together by discrete physical joints 16 to form a honeycomb pattern. The portion of each strip between two joints 16 forms a cell wall 18 of an individual cell 20. Each cell 20 has cell walls made from two different polymeric strips. For example, outside strip 22 and inside strip 24 are bonded together by physical joints 16 which are regularly spaced along the length of strips 22 and 24. A pair of inside strips 24 is bonded together by physical joints 32. Each joint 32 is between two joints 16. As a result, when the plurality of strips 14 is stretched in a direction perpendicular to the faces of the strips, the strips bend in a sinusoidal manner to form the geocell 10. At the edge of the geocell where the ends of two polymeric strips 22, 24 meet, an end weld 26 (also considered a joint) is made a short distance from the end 28 to form a short tail 30 which stabilizes the two polymeric strips 22, 24.

Figure 2:
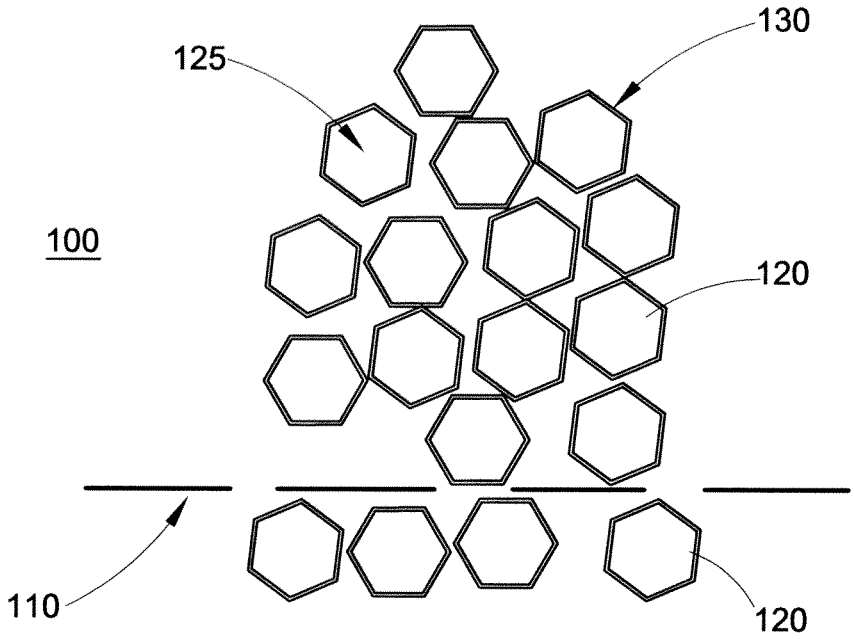
FIG. 2 illustrates an exemplary embodiment of a geotechnical structure comprising a geogrid and an encapsulated granular material.

FIG. 2 is a side cross-sectional view of one embodiment of a geotechnical structure 100. The geotechnical structure 100 comprises a geogrid 110, having a two-dimensional structure. Encapsulated granular material 120 is located both above and below the geogrid 110. The encapsulated granular material 120 comprises a granular material 125 and an organic cohesive material 130 encapsulating the granular material. Put another way, the granular material forms the core of the encapsulated granular material, and the organic cohesive material forms a shell around the granular material.

The organic cohesive material provides some novel characteristics to the granular material. First, the overall encapsulated granular material has a lower tendency to absorb water, compared to the granular material alone. This improves the bearing capacity under humid conditions, the resistance to frost heave, and reduces weight gain due to absorption of water (a critical issue in walls). Second, the organic cohesive material increases cohesion between particles. This improves toughness, strength, and interaction with the geosynthetic article. Finally, the organic cohesive material increases the effective particle size of the granular material. Since fine particles are agglomerated by the cohesive organic material, they become aggregated and thus contribute to the strength of the overall geotechnical structure. In particular embodiments, the encapsulated organic material consists of the granular material and the organic cohesive material.

Figure 3:
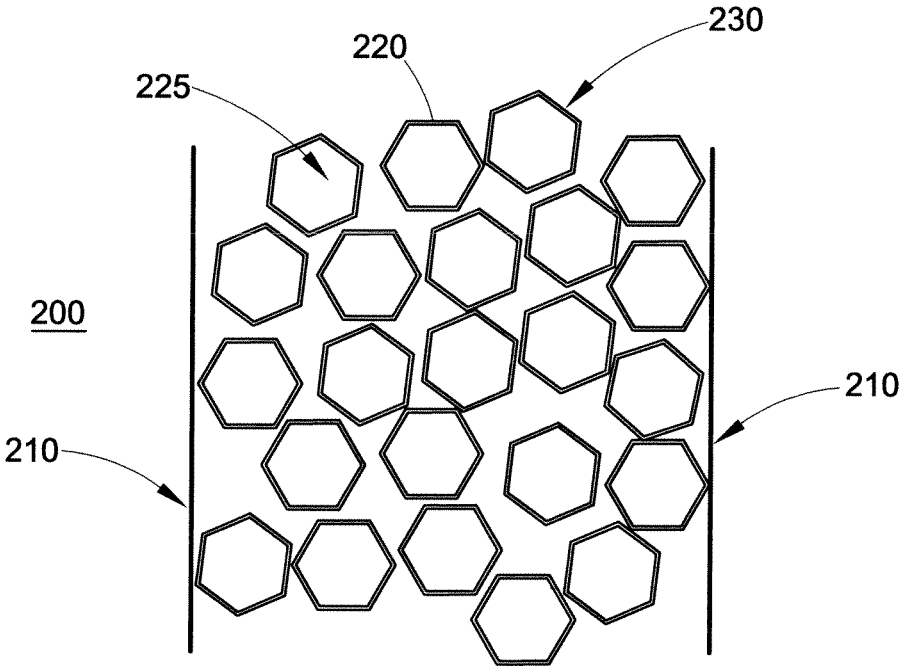
FIG. 3 illustrates an exemplary embodiment of a geotechnical structure comprising a geocell and an encapsulated granular material.

FIG. 3 is a side cross-sectional view of a second embodiment of a geotechnical structure 200. The geotechnical structure 200 comprises a geocell 210 similar to that shown in FIG. 1, wherein each cell is formed from two walls. An encapsulated granular material 220 is located within the walls of the cell. The encapsulated granular material 220 comprises a granular material 225 and an organic cohesive material 230 encapsulating the granular material.

Figure 4:
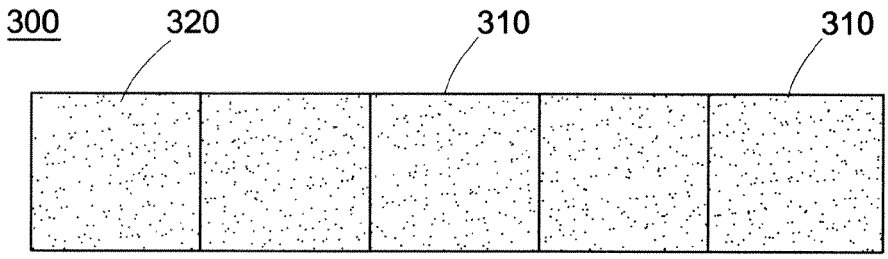
FIG. 4 illustrates an exemplary embodiment of a geotechnical structure comprising a geocell and compacted RAP.

In FIG. 4 is a top view of a geotechnical structure 300. The geotechnical structure 300 comprises a geocell 310 wherein each cell is a square made from four walls, rather than having the honeycomb shape of FIG. 1. Asphalt 320 is located within each cell 315 of the geocell 310.

Figure 5:
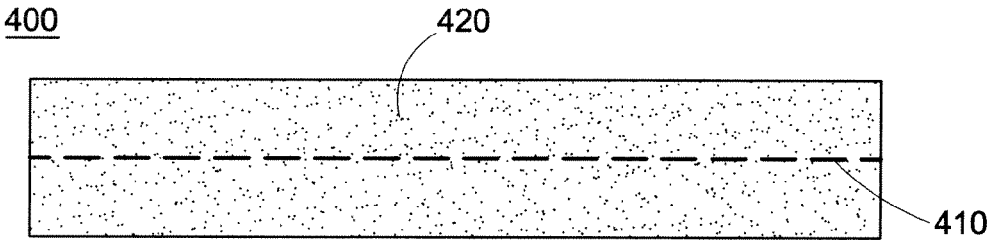
FIG. 5 illustrates an exemplary embodiment of a geotechnical structure comprising a geogrid and compacted RAP.

FIG. 5 is a side cross-sectional view of another geotechnical structure 400. The geotechnical structure 400 comprises a geogrid 410 and asphalt 420. The asphalt is placed both below and above the geogrid.

Figure 6:
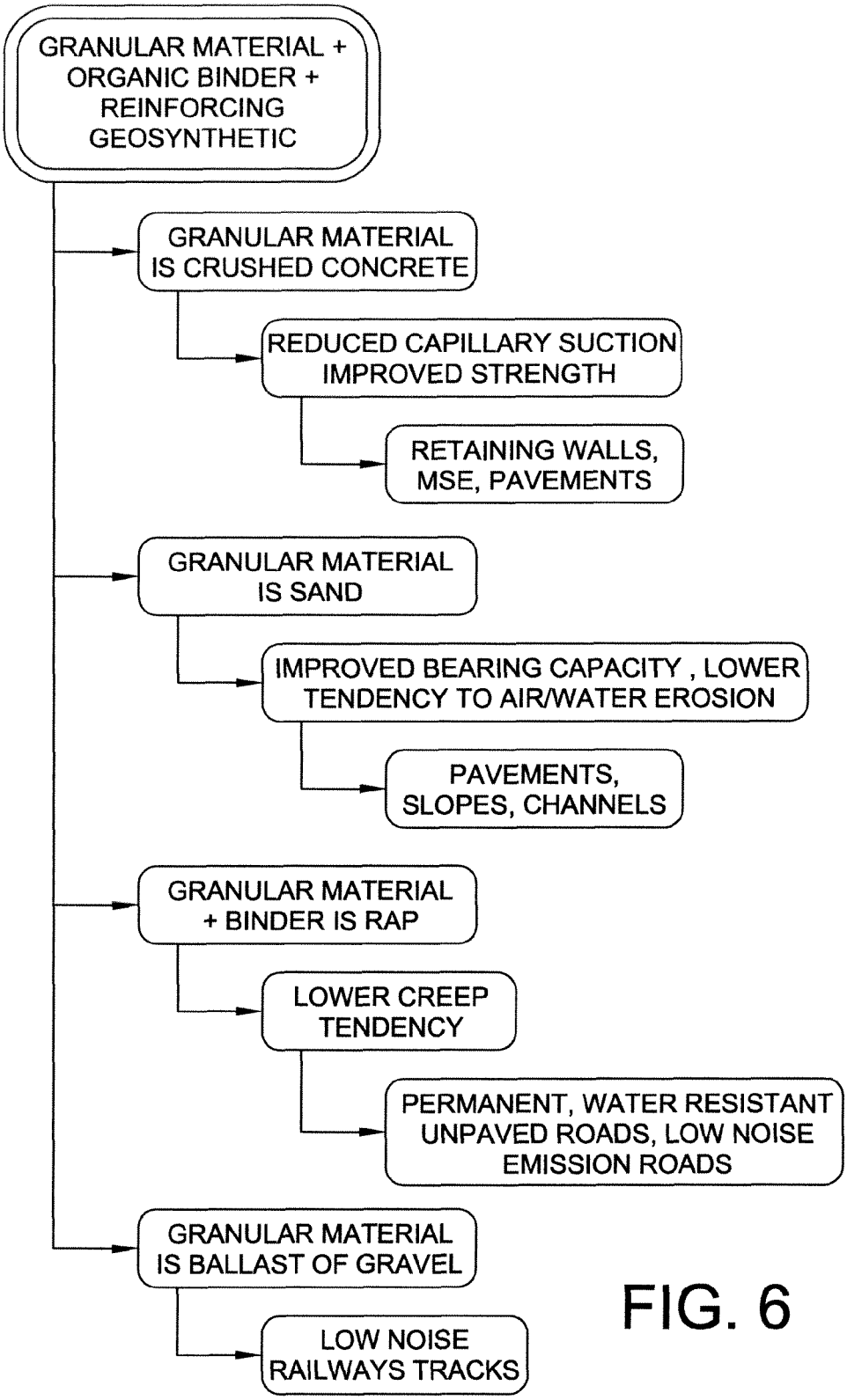
FIG. 6 is a chart describing the advantages of specific granular materials.

FIG. 6 lists some of the advantages and applications for geotechnical structures when different encapsulated granular materials are shown. When the granular material is crushed concrete, the organic cohesive material reduced water capillary suction and improved the strength of the geotechnical structure. The reduced water uptake improves the potential of the composition for retaining walls. Geotechnical structures including encapsulated crushed concrete may be useful in retaining walls, mechanically stabilized earth, and pavements. Sand exhibits improved load-bearing capacity and greater resistance to air and water erosion when encapsulated with an organic cohesive material. Geotechnical structures including encapsulated sand may be useful in pavements, slopes, walls, railways bases, and channels. Ballast or gravel is less noisy when encapsulated with an organic cohesive material. Geotechnical structures including encapsulated ballast or gravel may be useful in applications involving railway tracks. Recycled asphalt concrete (RAP) exhibits a lower creep tendency in geotechnical structures of the present disclosure. These geotechnical structures may be useful in permanent, water resistant, unpaved roads and low noise-emission roads. The examples listed in FIG. 6 are merely exemplary and are not meant to limit the present disclosure.

The geosynthetic article used in the geotechnical structure can be a geogrid, a geofabric, geotextile, or a geocell. Again, a geogrid, a geofabric, and a geotextile can be considered to be two-dimensional, whereas a geocell is three-dimensional. Each cell of a geocell has a cell height. A geofabric is formed from synthetic fibers to form a fabric that is porous across its plane. A geogrid differs from a geofabric in that the fibers or ribs of a geogrid are formed in a gridlike configuration, with large apertures between individual ribs in the machine and cross-machine directions. For example, a geogrid would look, from the top, like the geocell in FIG. 4.

Exemplary granular materials include sand, gravel, crushed concrete, crushed brick, crushed or granulated plastic, crushed glass, quarry screenings, and mixtures thereof. The plastic can be virgin, post-consumer, or recycled plastic.

The granular material may comprise from about 40 to about 99.9% by volume of the encapsulated granular material. The granular material may also comprise from about 45 to about 99.5% by volume or from about 48 to about 99.5% by volume of the encapsulated granular material. When compacted, pores may remain between encapsulated particles.

The granular material may have an average particle size of from about 0.004 mm to about 50 mm. In some embodiments, the average particle size is from about 0.05 mm to about 2 mm. The granular material may be well graded or poorly graded, as long as the gradation is within these ranges. One advantage of the encapsulation of the granular material with the organic cohesive material is the increase in average particle size, due to agglomeration of the finer particles.

Exemplary organic cohesive materials include asphalt, bitumen, bituminous emulsions, bitumen derivatives, polymer emulsions, polymer solutions, polymer dispersions, vegetable oil derivatives, and oil derivatives, carbohydrates and derivatives thereof, and proteins. The terms "asphalt" and "bitumen" are interchangeable here, and refer to a mixture of viscous, dark organic liquids that is composed primarily of highly condensed polycyclic aromatic hydrocarbons.

The organic cohesive material may comprise from about 0.01 to about 60% by volume, from about 0.1 to about 45% by volume, or from about 0.5 to about 40% by volume of the encapsulated granular material.

In particular embodiments, the encapsulated granular material is asphalt concrete. The term "asphalt concrete" as used herein refers to an aggregate that has been encapsulated by asphalt, i.e. bitumen or another oil derivative. Put another way, asphalt concrete is the combination of aggregate and asphalt, where asphalt acts as a binder. In everyday usage, "asphalt concrete" is often abbreviated to "asphalt"; such abbreviation is not used in this application.

In particular, recycled asphalt concrete (RAP) is to be used. Recycled asphalt concrete is readily available from road resurfacing. However, unless reinforced with a geosynthetic article, asphalt concrete is very sensitive to creep—especially at elevated temperatures, usually in the range of 30-70 Celsius, that are not uncommon during hot seasons on surface of roads.

Generally, the encapsulated granular material is dispersed upon or within the geosynthetic article. When the article is a geocell, the encapsulated granular material is placed within the cells of the geocell and compacted. Put another way, the geocell surrounds, confines, or encloses the encapsulated granular material.

The interaction of a geosynthetic article with the encapsulated granular material creates a novel unique combination of properties. On the one hand, a geosynthetic article alone cannot lower water adsorption, nor aggregate fine particles into larger agglomerates. On the other hand, an organic cohesive material cannot provide the confinement and mechanical strength that a geosynthetic article does, nor provide resistance to creep.

The geosynthetic article provides tensile strength, creep resistance and confinement to the encapsulated granular material.

In some embodiments, the geotechnical structure is used in an unpaved road. In such cases, the granular material is typically exposed and in direct contact with car wheels, as well as with wind, snow, rain, and other climate conditions.

In other embodiments, the geotechnical structure is used in a reinforced slope or wall. The geosynthetic article may be a geocell, a geotextile, and/or a geogrid. The encapsulated granular material may be crushed concrete or brick treated with asphalt, an oil derivative, vegetable oil and derivatives thereof, a carbohydrate and derivatives thereof, or a polymer emulsion, dispersion, or solution.

In still other embodiments, the geotechnical structure is used in an unpaved, water resistant road, parking lot, or pavement wherein the geosynthetic article is a geocell, geotextile, or a geogrid. The encapsulated granular material may be RAP, crushed concrete or brick treated with a bitumen derivative, oil derivative, vegetable oil and derivatives thereof, a carbohydrate and derivatives thereof, polymer emulsion, polymer dispersion, or polymer solution.

In particular embodiments, recycled asphalt concrete (RAP), i.e. the aggregate generated during rehabilitation of paved roads or parking lots, is used as the encapsulated granular material. One advantage of RAP is that the granular particles are already encapsulated with an organic cohesive material, i.e. the original asphalt binder. Thus, very little or no additional amount of organic cohesive material is required to be added. Using recycled asphalt concrete may be particularly cost-effective as such asphalt concrete is usually considered to be a waste material. Asphalt concrete already includes a bituminous compound, so at most only a small amount, usually 0.01-5% or 0.02-2% of additional organic cohesive material, as measured by weight of the asphalt concrete, is required. When asphalt concrete is compacted toward a geogrid or into a geocell, the creep tendency of the asphalt concrete is improved (i.e., the structure will creep less under the same loads and same temperature), especially at elevated temperatures. The result is a dimensionally stable and long-lasting geotechnical structure. A process is contemplated in which a paved road is resurfaced. The resulting "old" asphalt concrete is packed and compacted inside a geocell or upon a geogrid, to form a stable and creep resistant layer. This process of "in situ" RAP re-use is revolutionary because currently, RAP generated during resurfacing is transported to landfills or to recycling sites where it is screened and then mixed with asphalt binder—a very energy-consuming process.

The improved cohesion provided by the organic cohesive material, and especially with RAP, to the geosynthetic article increases friction and shear, thus improving stiffness, load-bearing capacity, and fatigue resistance. The geosynthetic article, particularly a geocell, reduces cold flow, creep, and plasticity, especially at temperatures above ambient.

In other embodiments, the geotechnical structure is used in an unpaved road and comprises at least one layer including compacted asphalt and a geogrid, a geocell, or a geofabric. The layer optionally further comprises an additional organic cohesive material. The unpaved road exhibits improved resistance to wind and rain erosion and improved load-bearing capacity for an extended lifetime.

The geotechnical structure may also be used in a paved road wherein the paved road comprises a top layer and at least one lower layer. The top layer may comprise asphalt concrete or concrete. The lower layer is a geotechnical structure formed from compacted asphalt concrete (especially compacted RAP), a geogrid or a geocell, and optionally an additional organic cohesive material. The lower layer may alternatively include (i) a compacted sand, crushed concrete, or crushed stone which is encapsulated with an organic cohesive material and (ii) a geogrid or a geocell.

Layers comprising asphalt concrete and a geosynthetic article are particularly cost-effective and easy to apply for use in unpaved roads or pavements. The unpaved roads of the present disclosure are significantly cheaper than paved roads but still durable and long-lasting, rain resistant, wind resistant, and frost-heave resistant.

A water permeable geotechnical structure for use in slopes, channels, walls, and pavements is also disclosed. For such applications, a combination of high hydraulic conductivity, excellent erosion resistance, and high bearing capacity is desirable. The geotechnical structure contains a layer of an encapsulated granular material, which allows for porosity even when compacted. The geosynthetic article may be a geogrid, a geocell, a geofabric, chopped fibers, or a naturally fibrous material. Exemplary fibers/fibrous materials include glass fibers, jute fibers, kenaf fibers, hemp fibers, flax fibers, polyester fibers, and polyamide fibers. As previously described, the encapsulated granular material is either placed within or upon the geogrid/geocell/geofabric. In the case of chopped fibers and naturally fibrous material, the fibers are mixed with the encapsulated granular material, then compacted together to form the geotechnical structure. The fibers provide increased tensile strength, creep resistance, and compressive strength to the geotechnical structure.

Processes for constructing geotechnical structures are also disclosed. In some embodiments, the construction process includes (1) placing a granular material into or onto a geosynthetic article, (2) contacting the granular material with an organic cohesive material, such as by spraying or pouring, to encapsulate the granular material, and (3) optionally compacting the encapsulated granular material. In other embodiments, the construction process includes (1) mixing a granular material with an organic cohesive material solution, emulsion, or dispersion to form an encapsulated granular material, (2) applying the encapsulated granular material into or onto a geosynthetic article, and (3) optionally compacting the encapsulated granular material.

Alternatively, the organic cohesive material may be added to the granular material after compaction.

The present disclosure will further be illustrated in the following non-limiting working examples, it being understood that these examples are intended to be illustrative only and that the disclosure is not intended to be limited to the materials, conditions, process parameters and the like recited herein.

EXAMPLES

Example 1

Recycled asphalt concrete was placed into a geocell and compacted. The recycled asphalt concrete was generated from the resurfacing of a paved road, and had particle sizes in the range of 0.1 to 50 mm. The cells in the geocell had a diameter of from about 200 to about 220 mm. The distance between seams was about 330 mm and the height was about 150 mm. The base (i.e. the layer beneath the reinforced RAP layer) was native soil having a California Bearing Ratio of 3. The resultant unpaved road performed similarly to a paved road even when soaked in water and subjected to cycling loads. The demonstration was done in a 120 cm×120 cm×120 cm box where the structure was constructed. A plate of 300 mm diameter was mounted at the center of the upper surface of the structure, and cyclic loads of (500 kilopascal surface pressure, 0.5 seconds duration, 1 Hz frequency) were applied. The performance was measured as the degree of penetration after 10,000 cycles. The RAP-geocell structure performed similar to new asphalt concrete.

Example 2

A erosion-resistant slope was prepared including an erosion resistant geotechnical structure. The erosion resistant geotechnical structure was formed from a geocell that had cell diameters of from about 200 to about 220 mm. The distance between the seams was about 330 mm and the height was about 200 mm. Encapsulated granular material was formed by treating sand with a bitumen emulsion. The bitumen emulsion content accounted for 1% of the sand volume. The encapsulated granular material was placed into the geocell to form the geotechnical structure. The slope was subjected to heavy rains for 2 periods, and exhibited outstanding resistance to erosion of sand. A control section, comprising similar sand and geocell, was subjected to significant erosion under similar conditions.

The geotechnical structures of the present disclosure have been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A geotechnical structure comprising:

a geosynthetic article; and an encapsulated granular material porously dispersed within the geosynthetic article, the encapsulated granular material comprising a core of a granular material and a shell of an organic cohesive material encapsulating the granular material.

2. The geotechnical structure of claim 1, wherein the geosynthetic article comprises a geogrid, a geofabric, a geotextile, or a geocell.

3. The geotechnical structure of claim 1, wherein the granular material has a particle size of from about 0.004 mm to about 50 mm.

4. The geotechnical structure of claim 1, wherein the granular material comprises crushed stone, dune sand, crushed concrete, or river sand.

5. The geotechnical structure of claim 1, wherein the granular material comprises from about 40 to about 99.9% by volume of the encapsulated granular material.

6. The geotechnical structure of claim 1, wherein the encapsulated granular material comprises asphalt concrete.

7. The geotechnical structure of claim 1, wherein the organic cohesive material comprises asphalt, a bituminous emulsion, a bitumen derivative, a polymer emulsion, a polymer dispersion, a polymer solution, an oil derivative, vegetable oil and derivatives thereof, a carbohydrate and derivatives thereof, a protein, and mixtures thereof.

8. The geotechnical structure of claim 1, wherein the geosynthetic article is a geocell or a geogrid; wherein the organic cohesive material is a bitumen derivative, a polymer emulsion, vegetable oil, or an oil derivative; and wherein the granular material is asphalt concrete, sand, or crushed concrete.

9. A geotechnical structure comprising:

a geotechnical article selected from a geocell or a geogrid; and an encapsulated granular material porously dispersed within the geotechnical article, the encapsulated granular material comprising a shell around a core;

wherein the organic cohesive material is a polymer emulsion, a polymer dispersion, or a polymer solution; wherein the polymer in the polymer emulsion, polymer dispersion, or polymer solution is a styrene-acrylate copolymer, a vinyl acetate, or an acrylate.

10. The geotechnical structure of claim 9, wherein the encapsulated granular material comprises asphalt.

11. A reinforced slope, embankment, or wall comprising:

a geotechnical article selected from a geocell, a geotextile, and a geogrid; and an encapsulated granular material porously dispersed within the geotechnical article, the encapsulated granular material comprising a core of a granular material and a shell of an organic cohesive material encapsulating the granular material.

12. The reinforced slope or wall of claim 11, wherein the granular material is sand, crushed stone, crushed concrete, or crushed brick; and wherein the organic cohesive material is asphalt, a bitumen derivative, an oil derivative, vegetable oil or derivatives thereof, a carbohydrate and derivatives thereof, a polymer emulsion, a polymer dispersion, or a polymer solution.

13. The reinforced slope or wall of claim 12, wherein the organic cohesive material is a polymer emulsion, a polymer dispersion, or a polymer solution; wherein the polymer in the polymer emulsion, polymer dispersion, or polymer solution is a styrene-acrylate copolymer, a vinyl acetate, or an acrylate.

14. A process for constructing a geotechnical structure, the process comprising:

mixing a granular material with an organic cohesive material to form an encapsulated granular material;

filling a geotechnical article with the encapsulated granular material; and optionally compacting the encapsulated granular material whereby pores remain between the encapsulated granular material.

15. The process of claim 14, further comprising compacting the encapsulated granular material.

16. The process of claim 14, wherein the granular material is sand, crushed concrete, or crushed stone.

17. The process of claim 14, wherein the geotechnical article is a geogrid or a geocell.

* * * * *